US005324905A

United States Patent [19]

Arnosti et al.

[11] Patent Number: 5,324,905

[45] Date of Patent: Jun. 28, 1994

[54] DRAWING ROLLER UNIT WITH SCAVENGING MEANS

[75] Inventors: Vittorino Arnosti, Pfungen; Rolf Widmer, Dorflingen; Konrad Boos, Sirnach; Armin Wirz, Ossingen, all of Switzerland

[73] Assignee: Rieter Machine Works, Ltd., Winterthur, Switzerland

[21] Appl. No.: 692,118

[22] Filed: Apr. 26, 1991

[30] Foreign Application Priority Data

Apr. 26, 1990 [CH] Switzerland ..... 01433/90-0

[51] Int. Cl.[5] ..... H05B 6/14

[52] U.S. Cl. ..... 219/619; 361/694; 219/645

[58] Field of Search ..... 219/10.61 A, 10.492, 219/469; 310/55; 361/382, 383, 384

[56] References Cited

U.S. PATENT DOCUMENTS

| | | | |
|---|---|---|---|
| 2,761,941 | 9/1956 | Ardichvili | 219/10.492 |
| 3,602,746 | 8/1971 | Clair | 310/55 |
| 3,879,594 | 4/1975 | Shillito | 219/10.492 |
| 4,005,302 | 1/1977 | Graf et al. | 219/10.61 A |
| 4,304,975 | 12/1981 | Lenk et al. | 219/10.492 |
| 4,425,489 | 1/1984 | Pav et al. | 219/10.492 |
| 4,464,593 | 8/1984 | Kofink | 310/55 |
| 4,822,972 | 4/1989 | Sugioka et al. | 219/10.492 |
| 4,859,887 | 8/1989 | Carlsson et al. | 310/55 |

FOREIGN PATENT DOCUMENTS

| | | |
|---|---|---|
| 0349829 | 1/1990 | European Pat. Off. . |
| 1018863 | 1/1953 | France . |

*Primary Examiner*—Philip H. Leung
*Attorney, Agent, or Firm*—Francis C. Hand

[57] ABSTRACT

A drawing roller unit is constructed with a godet and an electric motor mounted on a common shaft. A passage is provided throughout the unit to convey a non-flammable scavenging gas through the motor and the godet to reduce the risk of explosion due to sparking by the electric motor and/or other electrical parts of the drawing roller. The gas introduced can leave the unit only through a narrow gap. The pressure of the gas is consequently above atmosphere pressure and prevents the entrance of air.

19 Claims, 2 Drawing Sheets

DRAWING ROLLER UNIT WITH SCAVENGING MEANS

Figure 1:
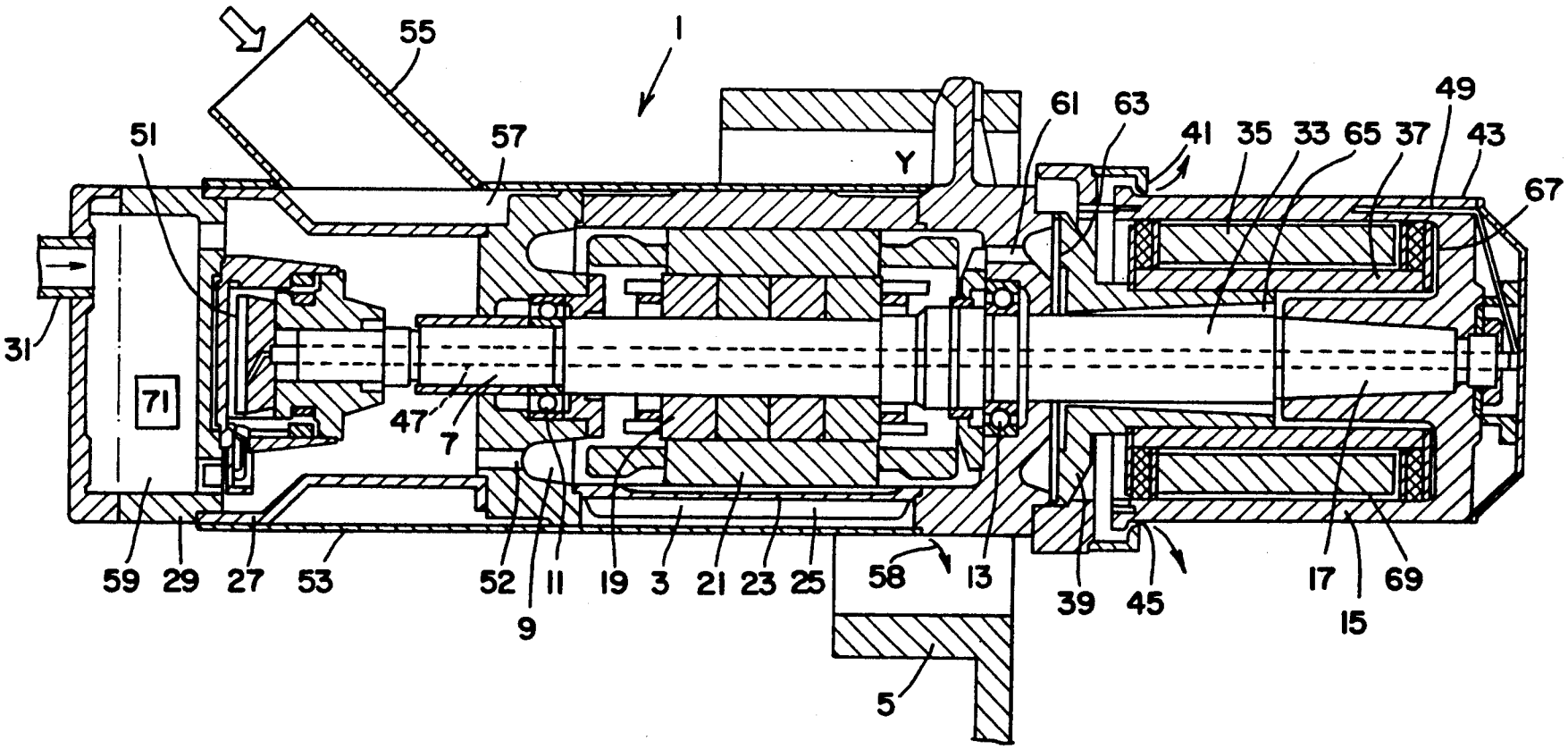

This invention relates to a drawing roller unit. More particularly, this invention relates to a drawing roller unit for incorporation into a draw winder, spin-draw winder or draw twister.

As is known, draw winders, spin-draw winders and draw-twisters have been constructed with inductively heatable godets which are usually driven by an independent electric motor. As is also known, sparking may occur not only in the electric motor but also in the godet particularly where the godet includes inductive heating windings.

As is also known, it has been conventional and often necessary for various types of preparations to be applied to a filament during a drawing operation. Such preparations usually contain a proportion of highly volatile combustible solvents which, during a drawing or stretching operation on a hot godet surface, may evaporate from the filament and combine with the ambient air to form a combustible and possibly explosive mixture which can be ignited by the sparking in a godet unit.

In order to reduce the risk of explosion, one possibility is to use a commercially obtainable explosion-proof construction for the godet drive instead of the conventional electrical driving motor. However, explosion-proof driving motors of this kind are much more expensive than the corresponding non-explosion-proof motors and are difficult to accommodate when they are required to be fitted subsequently in existing draw winders. In this case, all the monitoring and detecting elements for the godet must also be of explosion-proof construction and the godet must be explosion-proofed independently of the motor.

Accordingly, it is an object of the invention to reduce the risk of explosion in a draw roller unit employing a heated godet.

It is another object of the invention to provide a relatively inexpensive explosion-proof construction for a heated godet in a drawing roller unit.

Briefly, the invention provides a drawing roller unit which includes a shaft, an electric motor for rotating the shaft, an inductively heated godet mounted on the shaft for rotation therewith and passage means for passing a non-flammable gas through the motor and the godet for scavenging the motor and godet of combustible gases.

In one embodiment, the motor and godet are mounted on the shaft so that the passage means for the non-flammable scavenging gas passes sequentially through the motor and then the godet.

In a second embodiment, the motor and godet may be mounted on the shaft at opposite ends of a bearing housing for the shaft. In this case, the passage means includes a first flow path which extends through the motor for passing the scavenging gas therethrough as well as a second flow path which extends through the godet independently of the flow path through the motor so as to scavenge the godet.

The construction of the drawing roller unit allows the unit to be used in areas where there is a risk of explosion. In this respect, the construction enables the godet to be flooded with a non-flammable gas without any alterations in the dimensions of the unit so that the unit can be exchanged with conventional units.

In the first embodiment, the non-flammable gas can be introduced into a stationary part of the roller unit at an input end for subsequent passage through the motor and the godet by one or more chambers and through all such parts of the unit as are associated with spark. Further, the cross section of the passage means between the various components of the roller unit can be relatively small so that a constant positive pressure can be maintained even with a very small gas feed to the roller unit. In this respect, the supply of a small amount of scavenging gas should not affect the temperature of the surface of the godet. Further, the scavenging gas passing through the motor allows for cooling of the motor. This can be in addition to a separate passage means for passing cooling air over the motor for cooling of the motor. In this case, a stator of the motor can be cooled independently of the flooding or scavenging of a central part of the motor.

Of note, cooling of the motor, which calls for a substantial quantity of air, can be provided by ambient air since no sparks can occur in the cooling area.

The scavenging gas may act not only on the interior of the motor and an inductive heater employed in the godet but also on all the control elements, such as current supply leads extending to the motor and electronic components for monitoring the temperature of the godet. In this respect, a cylindrical covering can be provided concentric to the shaft and the electronic system with the passage means for the scavenging gas extending between the covering and the electronic system. Thus, the additional control elements can be received within the flow of scavenging gas without any substantial extra cost.

Since the scavenging gas is fed into the motor and particularly within a casing for the motor, mechanical seals are not required. Further, this motor casing need not need very stringent sealing requirements since the positive pressure necessary in the passage means for the scavenging gas is so small that minor losses are acceptable. Further, the minor positive pressure is great enough to prevent the entrance of air from the surroundings into the motor casing.

Figure 2:
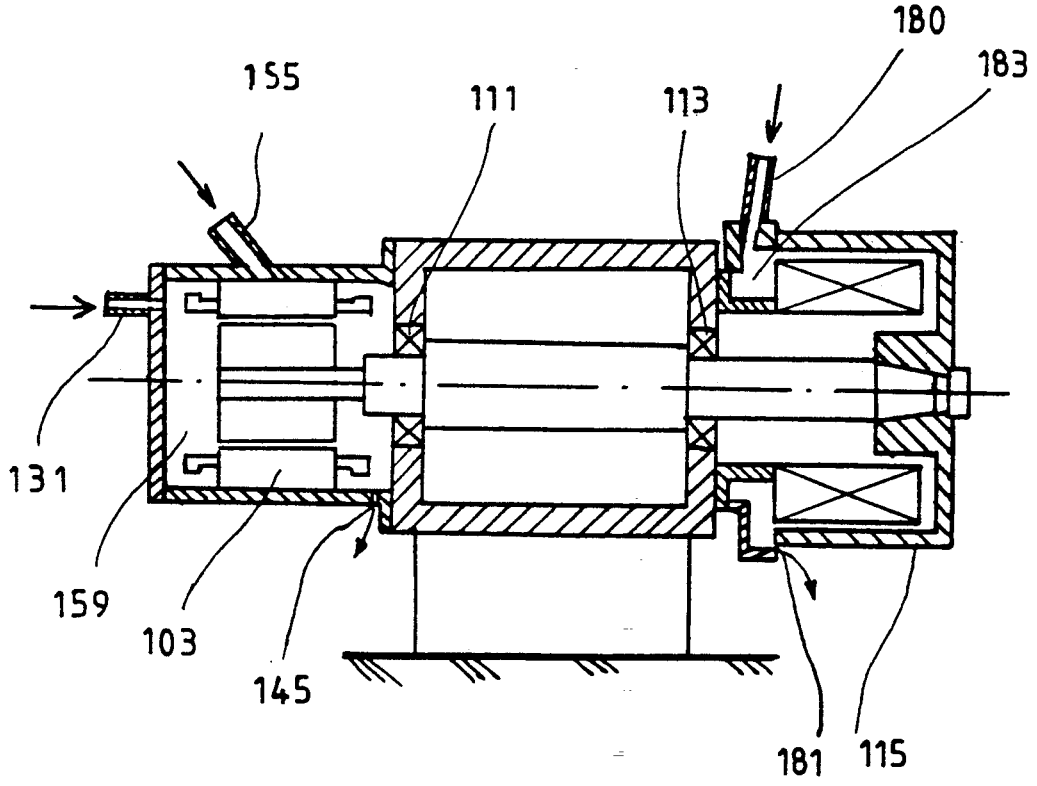

These and other objects of the invention will become more apparent from the following detailed description taken in conjunction with the accompanying drawings wherein:

FIG. 1 illustrates a cross sectional view of one embodiment of a drawing roller unit constructed in accordance with the invention; and FIG. 2 illustrates a cross sectional view of a further embodiment of a drawing roller unit constructed in accordance with the invention.

Referring to FIG. 1, the drawing roller unit 1 is constructed for mounting in a bearing frame 5 in either a rigid or a resilient manner. As indicated, the drawing roller unit 1 has a shaft 7, an electric motor 3 for rotating the shaft 7 and a godet 15 which is mounted on the shaft 7 for rotation therewith.

The motor 3 includes a casing 23, a stator 21 within the casing 23 and a rotor 19 which is mounted on the shaft 7 in a conventional manner within the stator 21. As indicated, the casing 23 is provided with a plurality of cooling ribs 25 only one of which is shown for purposes of simplicity on the outer surface.

The motor 3 has a cover secured on one side in which a bearing 11 is mounted for rotatably supporting the shaft 7. A similar cover is secured to the opposite end of the motor casing 23 and receives a second bearing 13 for rotatably supporting the shaft 7.

The godet 15 is of cup-shape and is secured onto a conical end 17 of the shaft by means of a washer and nut assembly or the like. In this respect, the mounting of the godet 17 on the shaft 7 is of generally conventional structure and need not be further described.

A stationary sleeve 37 which is concentric to and spaced from the shaft 7 is disposed within the godet 15 to serve as a mounting for an inductive heater 35. As indicated, the heater 35 is disposed in spaced relation to the inside wall of the godet 15 in order to define a small annular gap therebetween. This heater 35, as is known, serves to heat the godet 15 and particularly the outer peripheral surface 43, for example, for the heating of a filament passing over the godet.

As indicated, the sleeve 37 is mounted on a flanged sleeve 39 which is secured to the end cover of the motor 3 while being spaced from the shaft 7.

A suitable temperature probe 49 is disposed in the godet 15 adjacent to the peripheral surface 43 in order to sense the temperature of the godet 15. The probe 49 is connected with a feed line which extends through an axial bore 47 in the shaft 7. In addition, an electronic system 51 is disposed at the left-hand end of the shaft 7 for receiving signals from the feed line indicative of the sensed temperature of the godet 15.

As shown, a casing 27 is secured to the left-hand cover, as viewed, of the motor 3 concentric to the shaft 7 in order to receive electrical transmission elements (not shown) for the motor 3. This casing 27 is closed on one end by a screwed-on terminal box 29. In addition, a further cylindrical jacket-like covering 53 extends from the casing 27 over the motor casing 23 to a point over the cover at the right-hand end of the motor 3, as viewed.

The terminal box 29 is provided with a cover which is secured in place, as by bolts (not shown) and communicates with a gas feed line 31. In this respect, the terminal box 29 defines a chamber 59 for receiving a flow of gas from the feed line 31, for example, a non-combustible scavenging gas. In addition, a pressure monitoring part 71 is disposed within the terminal box 29 to monitor the pressure of the scavenging gas in the chamber 59.

A cooling air inlet 55 is connected to the casing 53 to serve as an inlet for cooling air. As indicated, the inlet 55 communicates with a ventilating space 57 formed by the two casings 27, 53. This ventilating space 57 communicates with an annular gap between the right-hand motor cover and the casing 53; an annular gap between the motor casing 23 and the casing 53; and the spaces afforded by the ribs 25 on the motor casing 23. In addition, an air outlet is disposed at the right-hand motor cover for the exhaust of the cooling air as indicated by the arrow 58 into a zone Y about the end of the casing 53 within the bearing housing 5.

A covering collar 41 is mounted in stationary manner about the left-hand godet 15 to form a small annular gap. As indicated, the collar 41 is secured to a further collar which is fixed to the end cover of the motor 3. Preferably, the material of which the collar 41 is made is softer than the material of the godet 15 to ensure that when the drawing roller unit 1 is being run in during commissioning, contact between the collar 41 and the surface 43 of the godet 15 does not damage the surface 43 while leaving a very narrow annular gap.

The unit 1 is provided with passage means for passing the non-flammable gas from the chamber 59 through the motor 3 and the godet 15 for scavenging the motor 3 and the godet 15 of combustible gases. As indicated, the passage means is constituted by a plurality of openings in the terminal box 29 which communicate the chamber 59 with the chamber defined within the casing 27. Thus, the scavenging gas also passes over the electronic system 51. Still further, the passage means includes bores 52 in the motor end cover to communicate the chamber within the casing 27 with an internal chamber 9 within the cover and with the space between the motor casing 23 and the stator 21. Additional scavenging gas may also flow in the spaces between the rotor 19 and the stator 21.

The right-hand end of the interior of the motor 3 communicates via suitable slots in a mounting nut for the bearing 13 and bores 61 in the right-hand cover of the motor with the interior of the godet 15.

As indicated, each bore 61 communicates with a disk-like chamber 63 between the flanged sleeve 39 and the motor end cover; an annular space 65 between the sleeves 37, 39 and a surface 33 of the shaft 7; and a radially disposed disk-like chamber 67 between the godet 15 and the induction heaters 35. This latter chamber 67 further communicates with an annular gap 69 which extends between the heater 65 and the interior surface of the godet 15 and which terminates in a chamber located between the godet 15 and the collar for mounting the collar 41. In this way, the scavenging gas is able to pass within the godet and particularly across the heater 35 in order to scavenge any combustible gases therefrom. As indicated by the arrow 45, the scavenging gas exits from the godet 15 through the annular space between the collar 41 and the outer surface 43 of the godet 15.

Of note, the elements of the electronic system 51 may, except where rotating parts are associated with stationary parts, be disposed outside the chamber 59 in a separate closed chamber. In this case, a large number of apertures would have to be sealed in air-tight manner. There would also be the possibility of producing the spark inducing elements in an explosion-proof form; however, costs would then be multiplied.

When the drawing roller unit 1 is in operation, a non-flammable scavenging gas such as nitrogen or clean air or another such gas flows through the gas feed line 31 into the chamber 59 of the terminal box 29. The gas then passes through the various bores and flow paths defined by the components of the motor 3 and godet 15 until exiting through the gap between the collar 41 and the godet 15 as indicated by the arrow 45. Alternatively, the scavenging gas may exit through an appropriate connecting line (not shown) into a place other than the place where the unit 1 is sited.

Since the annular gap between the collar 41 and godet surface 43 is narrow, a reduced gas feed suffices to pressurize the various passages and bores of the passage means and thus reliably prevents the entry of possibly explosive or flammable gas from the surroundings to the spark-producing components inside the roller unit 1.

In order to ensure that the gas which has been diffused in during manufacture or during a stoppage and which is of unknown composition may be reliably removed from within the unit, the non-flammable gas is taken in during a predetermined time of, for example, three minutes before placing the roller unit into operation.

The manner in which the scavenging gas operates during a drawing process can be continuously monitored by measurement of the positive pressure within the unit by means of one or more pressure gauges connected along the unit in communication with the flow passages of the scavenging gas.

Ambient air, even though containing gases which are a fire risk, can be taken in through the air feed inlet 55 and used to cool the motor 3. The scavenging gas which is taken in through the feed line 31 independently of the cooling air can be derived from a bottle or other suitable gas supply means (not shown) or from the atmosphere outside the place where the unit 1 operates.

Referring to FIG. 2, the drawing rolling unit may be constructed with a centrally disposed bearing housing having bearings 111, 113 for rotatably supporting the shaft therein. In this embodiment, the driving motor 103 is mounted on one end of the shaft to one side of the bearing housing while the godet 115 is mounted on the other end of the shaft on the opposite side of the bearing housing from the motor 103. As indicated, the passage means for the scavenging gas includes a first flow path which extends through the motor 103 and which is supplied with a scavenging gas via a gas feed line 131. As indicated, the gas would pass through the chamber 159 defined by the casing of the motor 103 while exiting through a small gap 145 in the motor casing.

The scavenging gas passage means also includes a second flow path which extends through the godet 115 independently of the flow path through the motor 103. In this respect, a gas feed line 180 is provided for feeding a scavenging gas into a chamber 183 within the godet 115 for passage through the various components within the godet with exhaust through a suitable gap 181 between the godet 115 and a stationary collar secured to the bearing housing.

In addition to the above, a feed line 155 is provided for passing cooling air about the motor 103 in a manner as described above.

Of note, the two gas feed lines 131, 180 can be connected with a common supply and/or discharge line (not shown).

The invention thus provides a drawing roller unit which is constructed so as to reduce the risk of explosions caused by sparking of an electric motor.

The invention further provides a relatively simple technique for passing a scavenging non-flammable gas through a motor and godet of a drawing roller unit.

What is claimed is:

1. A drawing roller unit comprising
a shaft;
an electric motor for rotating said shaft;
an inductively heated godet mounted on said shaft for rotation therewith;
first passage means for passing a non-flammable gas through said motor and said godet for scavenging said motor and said godet of combustible gases; and
second passage means separate from said first passage means for passing air over said motor for cooling said motor.

2. A drawing roller unit as set forth in claim 1 which further comprises current supply leads extending from said motor, electronic components for monitoring the temperature of said godet and induction windings for heating said godet and wherein said passage means extends about said supply leads, electronic components and said windings.

3. A drawing roller unit as set forth in claim 1 wherein said passage means includes a first flow path extending through said motor and a second flow path extending through said godet independently of said first flow path.

4. A drawing roller unit set forth in claim 1 further comprising a gas feed line for feeding a non-flammable gas into said passage means.

5. A drawing roller unit comprising
a rotatable shaft;
an electric motor for rotating said shaft;
a godet mounted on said shaft for rotation therewith;
an inductive heater within said godet for heating a peripheral surface of said godet;
first passage means for passing a non-flammable scavenging gas through said motor and said godet and over said inductive heater to scavenge combustible gas therefrom; and
second passage means separate from said first passage means for passing air over said motor for cooling said motor.

6. A drawing roller unit as set forth in claim 5 which further comprises at least one temperature probe in said godet for sensing the temperature of said godet, a feed line extending from said probe through said shaft and an electronic system at one end of said shaft for receiving signals from said feed line indicative of the sensed temperature of said godet.

7. A drawing roller unit as set forth in claim 6 which further comprises a cylindrical covering concentric to said shaft and said electronic system and wherein said first passage means extends between said electronic system and said covering.

8. A drawing roller unit as set forth in claim 5 wherein said motor has a casing, a stator within said casing and a rotor mounted on said shaft within said stator and wherein said passage means extends between said stator and said casing.

9. A drawing roller unit as set forth in claim 5 wherein said godet is of cup shape.

10. A drawing roller unit as set forth in claim 9 which further comprises a stationary sleeve concentric to and spaced from said shaft within said godet, said sleeve having said heater mounted thereon and wherein said first passage means extends between said sleeve and said shaft and between said heater and said godet.

11. A drawing roller unit as set forth in claim 10 which further comprises an annular collar spaced about one end of said godet to define an annular outlet of said first passage means.

12. A drawing roller unit as set forth in claim 5 wherein said first passage means includes a first flow path extending through said motor and a second flow path extending through said godet independently of said first flow path.

13. A drawing roller unit as set forth in claim 12 which further comprises a bearing housing between said motor and said godet for rotatably mounting said shaft therein and wherein said first flow path includes an inlet line for feeding non-flammable gas into said motor and an outlet between said motor and said housing.

14. A drawing roller unit as set forth in claim 13 wherein said second flow path includes an inlet line for feeding non-flammable gas into said godet and an outlet between said godet and said bearing housing for venting the gas therefrom.

15. A drawing roller unit comprising
a shaft;

an electric motor having electrical parts for rotating said shaft;

an inductively heated godet mounted on said shaft for rotation therewith;

first passage means for passing a non-flammable gas through said electrical parts of said motor and said godet for scavenging said motor and said godet of combustible gases, and for preventing entrance of combustible gases to said electrical parts; and second passage means separate from said first passage means for passing air over said motor for cooling said motor.

16. A drawing roller unit as set forth in claim 15 which further comprises current supply leads extending from said motor, electronic components for monitoring the temperature of said godet and induction windings for heating said godet and wherein said passage means extends about said supply leads, electronic components and said windings.

17. A drawing roller unit comprising a shaft;

an electric motor for rotating said shaft;

current supply leads extending from said motor;

an inductively heated godet mounted on said shaft for rotation therewith;

electronic components for monitoring the temperature of said godet and induction windings for heating said godet;

passage means extending about said supply leads, electronic components and said windings for passing a non-flammable gas through said motor and said godet for scavenging said motor and said godet of combustible gases, said passage means including a radially extending chamber at an end face of said induction windings and an annular chamber within a peripheral surface of said godet and extending from said radially extending chamber towards said motor.

18. A drawing roller unit as set forth in claim 17 wherein said passage means has an outlet communicating with atmosphere at an end of said godet near said motor.

19. A drawing roller unit as set forth in claim 18 wherein said outlet is disposed between said godet and a stationary covering collar.

* * * * *